United States Patent [19]

Trussardi

[11] Patent Number: 4,795,048

[45] Date of Patent: Jan. 3, 1989

[54] FLATTENED CONTAINER CAPABLE OF WITHSTANDING CRUSHING

[75] Inventor: Nicola Trussardi, Milan, Italy

[73] Assignee: Trussardi S.p.A., Milan, Italy

[21] Appl. No.: 76,161

[22] Filed: Jul. 21, 1987

[30] Foreign Application Priority Data

Jul. 28, 1986 [IT] Italy ..... 22663B/86

[51] Int. Cl.[4] ..... B65D 6/02

[52] U.S. Cl. ..... 220/4 B; 220/281; 220/315

[58] Field of Search ..... 206/232; 220/4 B, 4 E, 220/260, 281, 284, 306, 315

[56] References Cited

U.S. PATENT DOCUMENTS

| | | | |
|---|---|---|---|
| 1,103,859 | 7/1914 | Austin | 220/260 |
| 3,360,152 | 12/1967 | Leers | 220/4 E |
| 3,511,433 | 5/1970 | Andrews et al. | 220/4 E |
| 3,620,403 | 11/1971 | Rump | 220/4 E |
| 3,661,253 | 5/1972 | Cronkite . | |
| 4,030,597 | 6/1977 | McCarthy . | |
| 4,061,241 | 12/1977 | Retelny . | |
| 4,155,500 | 5/1979 | Dutcher . | |
| 4,294,299 | 10/1981 | Dorsen et al. . | |

FOREIGN PATENT DOCUMENTS

| | | | |
|---|---|---|---|
| 0952449 | 8/1974 | Canada | 220/4 B |
| 0158429 | 10/1985 | European Pat. Off. . | |
| 0999375 | 1/1952 | France | 220/4 B |
| 1078174 | 11/1954 | France | 220/4 B |
| 1464021 | 2/1977 | United Kingdom . | |

*Primary Examiner*—Jimmy G. Foster

*Attorney, Agent, or Firm*—Young & Thompson

[57] ABSTRACT

A container consists of a flattened body made up of two slightly convex half shells that can be locked together forming an inner cavity to hold a small amount of a product. Preferably each half shell has an edge that couples with the edge of the other half shell. One of the two half shells is provided with fasteners designed to cooperate with the matching portions of the other half shell. A projection, equipped with a peripheral fastener and a central fastener may also be provided.

2 Claims, 2 Drawing Sheets

FLATTENED CONTAINER CAPABLE OF WITHSTANDING CRUSHING

The present invention concerns containers for samples of liquid products, loose or on a support, that are distributed in small amounts, for example attached to magazines as part of an advertising campaign.

It must be noted first of all that packaging for small amounts of a product must be inexpensive so as not to have too great an effect on the overall value of the goods. This packaging is normally in plastic sachets which are then tightly packed and stacked and handled without any precautions during transport. In particular they may be subjected to sharp impact, causing violent crushing of the package.

Under this high stress one or more sachets may burst, releasing the product which is thus lost, but above all causing damage to all the adjacent containers.

The aim of the present invention is to create an inexpensive container for small amounts of liquid products, loose or on a support, that will remain intact through all the rough handling of distribution.

The above aim is achieved by creating a flattened container made up of two slightly convex half shells which can be locked together, into which a small amount of the product to be packed is introduced.

Each half shell preferably ends in a rigid, shaped edge that engages with the edge of the other half shell. Fastening means are also envisaged to ensure that the shells engage with each other when the container is closed.

A hollow is preferably provided in the centre of the bottom of the container to allow for opening.

The present invention, according to a preferred but unrestrictive embodiment, is illustrated in the attached figures in which.

Figure 1:
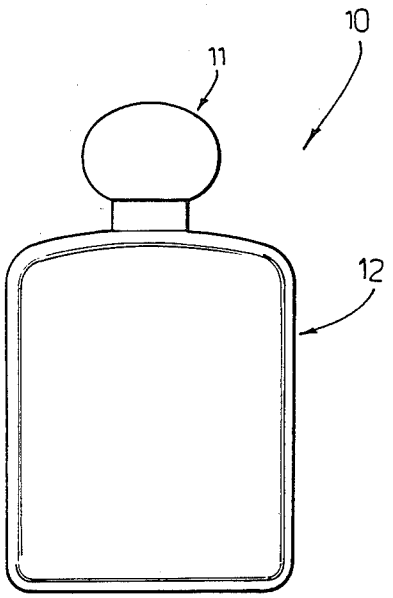
FIG. 1 shows a front view of the flattened container.
Figure 2:
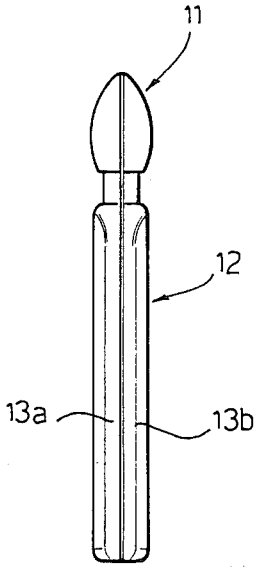
FIG. 2 is a side view.

FIG. 1 shows the front of the container. It consists of the flattened body 12 and a shaped projection 11 integral with the body. In FIG. 2 the container is shown from the side; the two slightly convex half shells **13*a* and 13*b* into which it can be separated are visible. Each of them is surrounded by edges 7 and 8** respectively that create a crush-proof, rigid area protecting the product.

These edges are shaped so that they can be coupled together.

Figure 3A:
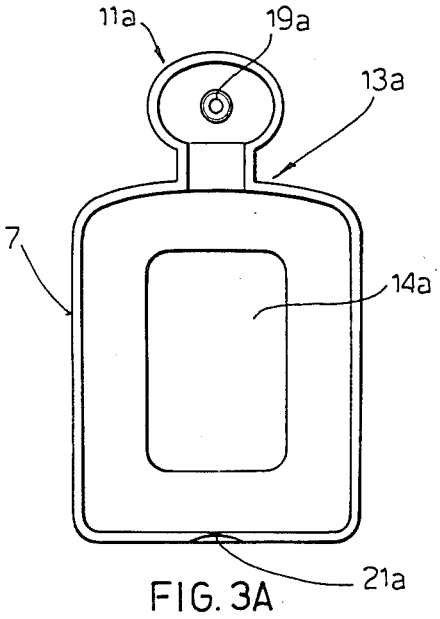
FIGS. 3A and 3B show the inside of the two half shells into which the container can be separated.
Figure 3B:
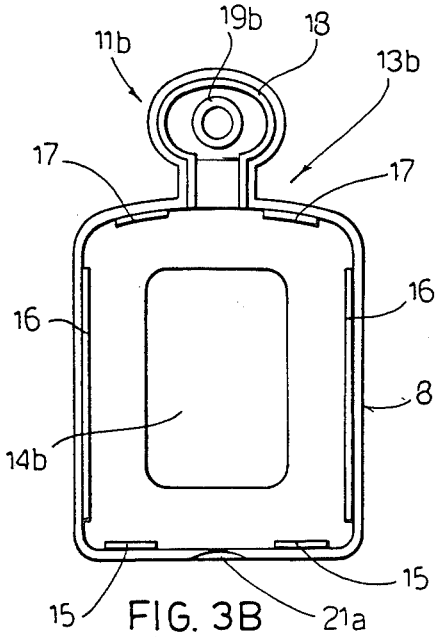

The inside of the two half shells **13*a* and 13*b* is shown in FIGS. 3A and 3B. In FIG. 3A the inside of the half shell 13*a* is shown. The centrally positioned half housing 14*a*, the central engaging means 19*a* of projection 11*a* and the half hollow 21*a*** can be seen.

FIG. 3B shows the inside of half shell **13*b* . The half housing 14*b* and the lower fastening means 15, side fastening means 16 and upper fastening means 17, designed to adhere to the inner edge of half shell 13*a***, can be seen.

Each half shell **13*a* and 13*b* is equipped with a projection 11*a*, 11*b*. The projection 11*b* has a peripheral fastening means 18 and a central engaging means 19*b*, the peripheral fastening means 18 being such as to adhere to the inner edge of the projection 11*a* and the central engaging means 19*b* being such as to accommodate its corresponding part 19*a* set at the centre of the projection 11*a***.

To allows the container 10 to be opened, half hollows **21*a* are envisaged at the bottom of each half shell 13*a* and 13*b***, forming a single hollow when the container is closed; said hollow is used for the action which releases the fastening means and separates the two half shells.

Figure 4:
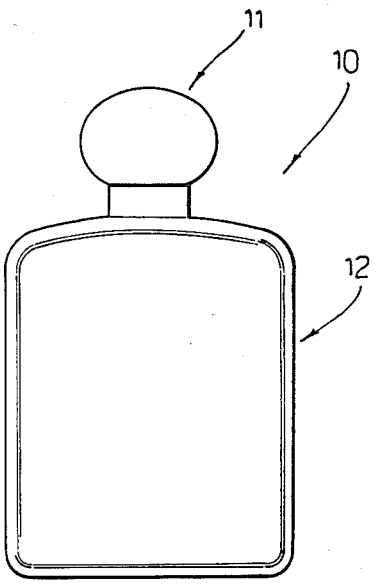
FIG. 4 shows the rear of the container.
Figure 5:
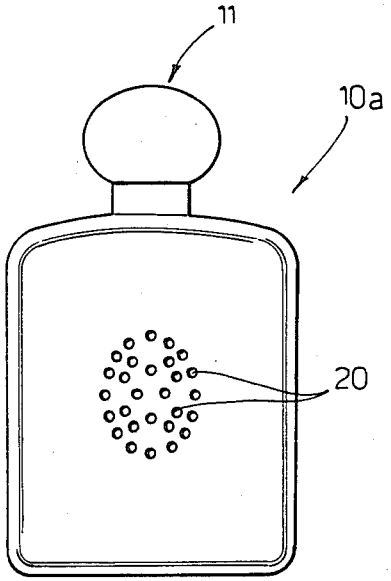
FIG. 5 shows the rear of the container according to a further embodiment.
Figure 6:
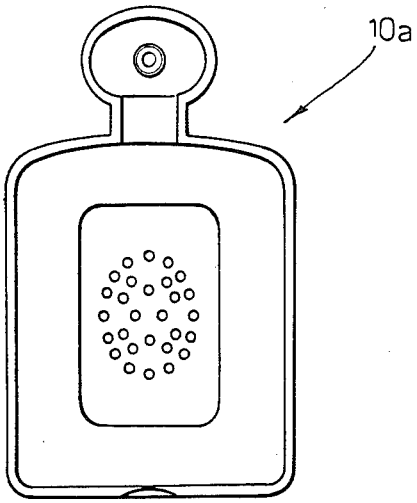
FIG. 6 shows a front view of the inside of the rear half shell of the container in FIG. 5.

FIG. 4 shows the rear of a container 10. FIG. 5 shows the rear of a container **10*a* according to a further embodiment. The wall has openings 20**, preferably in the form of round holes. In this case the container is particularly suitable for holding a support impregnated with a perfumed liquid and the holes allow the perfume to emanate into the room in which the container is placed. FIG. 6 shows a view from the inside of the half shell in FIG. 5.

What I claim is:

1. A container in the form of a flattened body comprised by two slightly convex half shells that can be locked together to form an inner cavity holding a small amount of a product, the flattened body having a projection that extends from an edge of the flattened body and is comprised by two half projections one on an edge of each of said half shells, one of the two half projections having a peripheral fastening means adapted to releasably adhere to an inner side of a peripheral portion of the other half projection, each of said half projections having a central engaging means surrounded by said peripheral fastening means, said central engaging means of the two half projections being adapted to releasably adhere to each other when pressed together.

2. A container according to claim 1, in which said central engaging means comprise a central protuberance on one said half projection adapted resiliently to fit within an annular coaxial protuberance on the other half projection.

* * * * *